United States Patent [19]

Oka et al.

[11] 4,310,563

[45] Jan. 12, 1982

[54] METHOD FOR AUTOMATICALLY CONTROLLING COMPOSITION OF CHEMICAL COPPER PLATING SOLUTION

[75] Inventors: Hitoshi Oka, Yokohama; Kenji Nakamura, Fujisawa; Hitoshi Yokono, Yokohama; Tokio Isogai, Fujisawa; Akira Matsuo, Yokohama; Osamu Miyazawa; Isamu Tanaka, both of Yokosuka, all of Japan

[73] Assignee: Hitachi, Ltd., Tokyo, Japan

[21] Appl. No.: 197,150

[22] Filed: Oct. 15, 1980

[30] Foreign Application Priority Data

Feb. 29, 1980 [JP] Japan ..... 55/24048

[51] Int. Cl.[3] ..... C23C 3/02; B05D 1/18

[52] U.S. Cl. ..... 427/8; 427/430.1; 427/437

[58] Field of Search ..... 427/8, 430.1, 437

[56] References Cited

FOREIGN PATENT DOCUMENTS 53-149389 12/1978 Japan .
54-1093 1/1979 Japan .
54-83635 7/1979 Japan .

*Primary Examiner*—James R. Hoffman
*Attorney, Agent, or Firm*—Craig and Antonelli

[57] ABSTRACT

The pH of a chemical copper plating solution is exactly measured for a prolonged time by utilizing a copper oxide prepared by etching metallic copper in an 0.1–1 N inorganic acid then oxidizing the etched metallic copper in an aqueous 0.1–1 N alkali metal hydroxide solution as a main electrode for pH measurement or reducing agent concentration measurement in terms of pH.

A combination of the pH measurement with well known procedures for measuring concentrations of cupric ions and a complexing agent exactly measures the pH and the concentrations of a reducing agent, cupric ions and a complexing agent for a continuation of longer time than the conventional procedures.

8 Claims, 4 Drawing Figures

METHOD FOR AUTOMATICALLY CONTROLLING COMPOSITION OF CHEMICAL COPPER PLATING SOLUTION

BACKGROUND OF THE INVENTION

1. Field of the Invention

The present invention relates to a method for controlling the composition of aqueous solutions including a chemical copper plating solution, and more particularly to a method for continuously and automatically controlling the pH of a chemical copper plating solution, the concentration of a reducing agent, the concentration of copper ions and the concentration of a complexing agent with good exactness.

2. Brief Description of the Prior Art

In the bright plating of ABS resin for decoration, a copper ground plating film is usually formed on the resin surface by chemical copper plating to give an electroconductivity to the resin surface. In that case, the mechanical strength of the ground plating film is no problem, and thus control of the composition of a chemical copper plating solution having an effect upon a plating film is intermittently carried out.

According to the recent technique, a conductor is directly formed on an insulating substrate by chemical copper plating. In that case, the mechanical characteristics of the plating film are regarded as important in addition to the electroconductivity of the plating film. The mechanical characteristics of a chemical copper plating film depend upon concentration of the main components of a chemical copper plating solution. Thus, it is necessary to continuously control the composition of a chemical copper plating solution.

According to the prior art, continuous control of a chemical copper plating solution is carried out in the following manner (a)–(c) as to pH, concentration of a reducing agent, concentration of copper ions and concentration of complexing agent.

(a) pH: A predetermined volume of a chemical copper plating solution (for example, pH 12.3) is admixed with a predetermined volume of an acid solution of predetermined concentration to adjust the pH to 4–9, and the pH of the solution is measured as a potential by means of glass electrode-calomel electrode. When there is a difference between the measured potential and the potential of fresh plating solution, the difference in potential is transmitted as a signal to actuate a controller, and a makeup solution is added to the plating solution to adjust the pH value of that of the fresh plating solution (Japanese Laid-open Patent Application Specification No. 83635/79).

(b) Concentration of reducing agent: A predetermined volume of a chemical copper plating solution is admixed with sodium sulfite in excess of the necessary amount for reaction with the total amount of formaldehyde as the reducing agent and also with an inhibitor for autodecomposition of sodium sulfite, thereby allowing formaldehyde to react with sulfite ions, and then admixed with iodine and a buffer agent, thereby allowing the unreacted sulfite ions to react with excess iodine, and an equilibrium potential between the remaining iodine and iodine ions is measured by means of gold electrode-calomel electrode. When there is a difference between the measured potential and the potential of the fresh plating solution, a controller is actuated to supply a makeup solution to the plating solution and make the concentration of formaldehyde equal to that of the fresh plating solution (Japanese Laid-open patent application specification No. 1093/79).

(c) Concentrations of $Cu^{+2}$ ions and complexing agent: In a chemical copper plating solution, there is a complexing agent in excess of $Cu^{+2}$ ions. A predetermined volume of a chemical copper plating solution is admixed with metal ions such as $Fe^{+3}$, etc. to form complex compounds among the metal ions, the complexing agent liberated by consumption of $Cu^{+2}$ ions due to the plating, and the complexing agent existing in a liberated state from the beginning. A change in potential between the plating solution before the addition of $Fe^{+3}$ ions and that thereafter is measured by means of gold electrode-calomel electrode to find the concentration of liberated complexing agent. By subtracting the found concentration value of the liberated complexing agent from the known concentration value of total complexing agents in a fresh chemical copper plating solution, the amount of the complexing agent taking part in complexing with $Cu^{+2}$ ions, that is, the amount of $Cu^{+2}$ ions, is indirectly determined. When there is a difference between the determined amount and the amount of the fresh chemical copper solution, a controller is actuated to supply a makeup solution to the plating solution and make the amount of $Cu^{+2}$ ions equal to that of the fresh plating solution (Japanese Laid-open patent application specification No. 149389/78).

Concentration of the total complexing agents is determined by adding $Fe^{+3}$ in an amount large enough to react with all the complexing agents and by measuring the potential by means of gold-electrode-calomel electrode. When there is a difference between the measured amount of total complexing agents and the amount of the fresh plating solution, a controller is actuated to supply a makeup solution to the plating solution and make the amount of the total complexing agents equal to that of the fresh plating solution (Japanese Laid-open patent application specification No. 149389/78).

However, the foregoing procedure (a) has such a disadvantage that the glass of glass electrode is attacked by the chemical copper plating solution, and consequently continuous measurement is only possible for a few hours, and a measurement error will be considerable after about 3 hours.

The foregoing procedures (b) and (c) also have such a disadvantage that, if the pH measured is not exact, $[I^-]/[I_2]$ used in the quantitative determination of formaldehyde fails to serve as an index in the procedure (b), and the reaction of $Fe^{+3}$ ions with the complexing agent fails to proceed exactly in the procedure (c), and thus in both procedures (b) and (c) exact control of the concentration of reducing agent, the concentration of $Cu^{+2}$ ions and the concentrations of total complexing agents will not be carried out after about 3 hours.

SUMMARY OF THE INVENTION

An object of the present invention is to provide a method for measuring the pH of a chemical copper plating solution, an acidic solution, an alkaline solution, etc., or the pH of a chemical copper plating solution and the concentration of a reducing agent thereof in terms of the pH value with good exactness for a continuation of at least 24 hours, free from the above-mentioned disadvantages of the prior art.

Another object of the present invention is to provide a method for measuring the pH, the concentration of $Cu^{+2}$ ions and the concentration of a complexing agent of a chemical copper plating solution, or the pH, the concentration of $Cu^{+2}$ ions, the concentration of a complexing agent and the concentration of a reducing agent of a chemical copper plating solution with good exactness for a continuation of at least 24 hours.

These objects can be attained by a combination of a pH-measuring system and a reducing agent-measuring system, both systems using, as the main electrode, copper oxide prepared by slightly etching metallic copper in a 0.1–14 N acid and then treating the etched metallic copper with an hydroxide of alkali metal, with a control system according to the aforementioned procedure (c).

Preferable copper oxide electrode is the one prepared by etching metallic copper having a purity of at least 99.9%, or 99.9–99.999% in view of cost, in an inorganic acid selected from 0.1–14 N nitric acid, hydrochloric acid, and sulfuric acid at a liquid temperature of 18°–50° C. for 1–10 seconds and then oxidizing the etched metallic copper in an aqueous 0.1–1 N solution of an alkali metal hydroxide such as caustic soda, caustic potash, etc. at a liquid temperature of 18°–50°0 C. for 5–30 minutes. Copper oxide electrodes prepared under other conditions than the above-mentioned fail to have stabilized copper oxide surface, and are thus not preferable.

At a copper oxide electrode, reaction of the following equation (1) takes place between the electrode and, for example, a chemical copper plating solution, when a calomel electrode is used as a reference electrode, and a potential is determined according to the following equation (2):

$$Cu_2O+H_2O \rightarrow 2CuO+2H^{+}+2e^{-} \quad (1)$$

$$E=0.669+0.0591\ pH \quad (2)$$

E in equation (2) is shown by a potential (V) on the basis of the hydrogen electrode. The reaction of equation (1) depends only upon pH. That is, the reaction is not influenced even by the concentration of copper ions in a chemical copper plating solution. In other words, deterioration of electrode due to reduction and deposition of copper ions, that is, the so-called electrochemical substitution reaction never takes place at all. Moreover, the copper oxide electrode is not attacked by a chemical copper plating solution. Thus, the pH of a chemical copper plating solution can be detected exactly and stably as a potential change.

The reaction of equation (1) is stable, because, even if cupric oxide on the electrode surface is dissolved by a divalent copper ion-chelating agent in a chemical copper plating solution, cuprous oxide on the electrode surface is oxidized to cupric oxide by the oxygen dissolved in the chemical copper plating solution, and the cuprous oxide is supplemented by the oxidation of metallic copper as the electrode base. Thus, the pH of a chemical copper plating solution can be determined by measuring a potential by means of a reference electrode or an auxiliary electrode. In the copper oxide electrode there is a particularly stable relationship between a pH of a chemical copper plating solution and a potential when the pH of the chemical copper plating solution is 11 or higher. That is, a relationship of the following equation (3) is obtained at 25° C.:

$$E=-0.0019\times pH^{4.75}\ (V_{vs.}S.C.E.) \quad (3)$$

A concentration of formaldehyde as a typical reducing agent in a chemical copper plating solution is indirectly determined by admixing a predetermined volume of a chemical copper plating solution of predetermined concentration with a sodium sulfite solution in a volume and at a concentration large enough to complete reaction of the following equation (4) to change the pH of the plating solution, and by measuring a change in pH by means of the copper oxide electrode and a reference electrode:

$$HCHO+Na_2SO_3+H_2O \rightarrow NaOH+HCH(NaSO_3.)OH \quad (4)$$

The reference electrode to be used in combination with the copper oxide electrode is the ordinary electrode such as calomel electrode, silver-silver chloride electrode, etc.

In the preparation of copper oxide electrode, an inorganic acid such as hydrochloric acid, sulfuric acid, nitric acid, etc., preferably nitric acid, is used as the acid. As the alkali-metal hydroxide, NaOH and KOH are practically used. As the metallic copper, copper having a purity of 99.9% or higher is preferable and can be used in any form, for example, plate or wire.

The concentration of the reducing agent can be measured likewise with good exactness, because the pH can be measured with good exactness.

For the measurement of the concentration of copper ions and the complexing agent, a non-soluble electrode, for example, electrodes of gold, platinum, tungsten, carbon, palladium, etc. can be used as the main electrode, and the auxiliary electrode.

The present invention will be described in detail below, referring to Examples and Drawings.

DETAILED DESCRIPTION OF THE PREFERRED EMBODIMENTS

EXAMPLE 1

Figure 1:
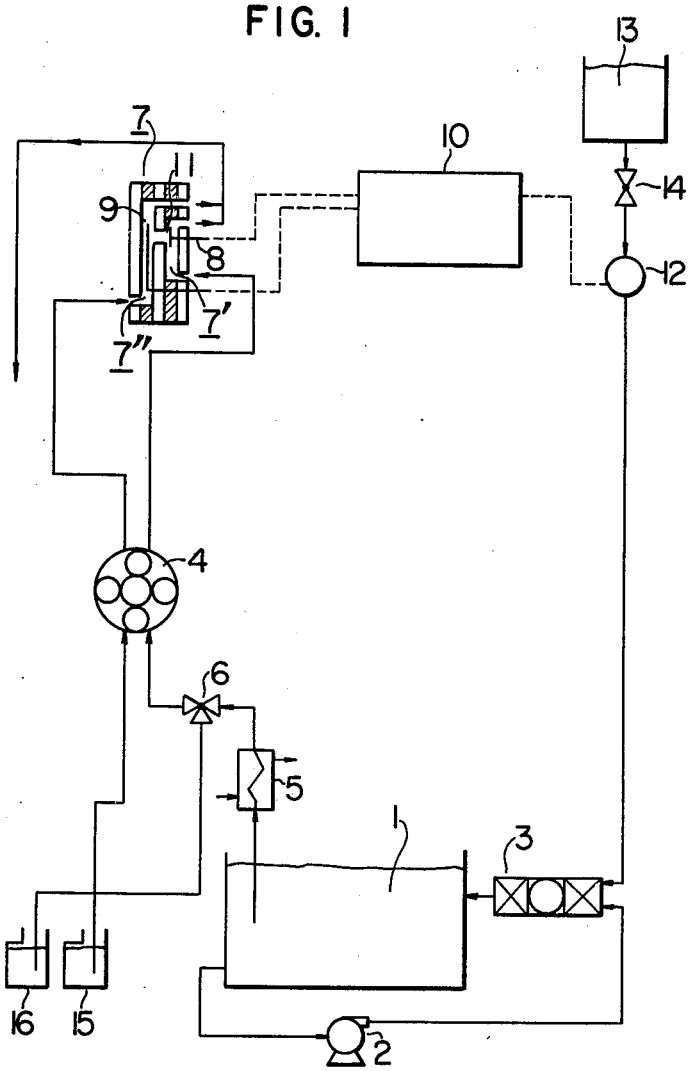
FIG. 1 to FIG. 4 are schematic flow diagrams showing embodiments of automatic control systems for controlling the composition of a chemical plating solution according to the present invention.

A chemical copper plating solution having the following composition as given below under (a) was placed in a plating tank 1 as shown in FIG. 1, and subjected to chemical copper plating under the following plating conditions as given below under (b). The plating solution was circulated and stirred by a circulation pump 2 and a mixer 3. The plating solution was sampled for analysis by a sampling pump 4 through a cooler 5 and a three-way electromagnetic valve 6, and led to a pH detection cell 7 for the plating solution, the cell comprising a main electrode chamber 7' and a reference electrode chamber 7'', and a difference in potential was detected between a copper oxide electrode 8, prepared by etching naked copper wire (purity 99.9%) with a diameter of 1 mm in 0.1 N nitric acid at a liquid temperature of 50° C. for 10 seconds and then oxidizing the etched copper wire in an aqueous 0.1 N caustic soda solution at a liquid temperature of 50° C. for 30 minutes and a silver-silver chloride electrode 9 as a reference electrode by means of a controller 10. Numeral 11 is a membrane.

(a) Composition of chemical copper plating solution

| | |
|---|---|
| $CuSO_4 \cdot 5H_2O$ | 13 g |
| EDTA-2Na | 40 g |
| NaOH | 12 g (pH 12.3) |
| 37% formalin | 3 ml |
| $K_2S$ | 0.0001 g |
| Polyethyleneglycol Stearylamine | 0.1 g |
| Water to make total volume 1 l | |

(b) Plating conditions

| | |
|---|---|
| Plating temperature: | 70° C. |
| Plating load: | 500 $cm^2$ copper plate |
| Plating solution volume: | 5 l |
| Plating rate: | 3.0 μm/hr |

(c) Standard solution for reference electrode
Aqueous saturated KCl solution
(d) Washing solution for copper oxide electrode
Aqueous 7 N nitric acid solution
(e) Makeup solution for adjusting pH of the plating solution

| | |
|---|---|
| NaOH | 200 g |
| Water to make total volume 1 l | |

When the detected potential was smaller than the potential preset in the controller 10 as an absolute value, a signal was transmitted from the controller 10 to a makeup pump 12 to supply a makeup solution as given above under (e) to the plating tank 1 from a makeup solution tank 13 for adjusting pH of the plating solution, through a valve 14, and the mixer 3 until the detected potential exceeded the preset potential. The sampled solution leaving the pH detection cell was thrown away. On the other hand, an aqueous saturated KCl solution was continuously supplied to the reference electrode chamber 7'' from a standard tank 15 as a standard solution for the reference electrode by the sampling pump 4, as given above under (c) to obtain a stable potential from the silver-silver chloride electrode in the reference electrode chamber 7''.

The aqueous saturated KCl solution leaving the reference electrode chamber 7'' was also thrown away.

Furthermore, an aqueous 7 N nitric acid solution was supplied to the main electrode chamber 7' from a washing solution tank 16 as a washing solution for the copper oxide electrode for about 10 seconds through the sampling pump 4 before conducting the automatic control of the plating solution, as given above under (d), by switching the three-way electromagnetic valve 6. The plating solution could be thus automatically controlled for a continuation of 168 hours, where the sampling rate of the sampling pump 4 was 50 ml/l, the detection temperature of the sampled plating solution was about 25° C. owing to the cooler 5, and the preset potential for the pH of the plating solution was −0.260 V.

EXAMPLE 2

A chemical treating solution as given below under (a) was used in metal pickling . The pH of chemical treating solution was continuously controlled to −0.08 (1.2 N in hydrogen ion concentration) in the same system as in FIG. 1 in the same manner as in Example 1, except that a copper oxide electrode as given below under (b), a makeup solution for adjusting pH of the chemical treating solution as given below under (d), and a standard solution for reference electrode as given below under (e) were used, a titrating solution as given below (c) was added to the main electrode chamber 7' of FIG. 1, and the chemical treating solution adjusted to pH 11 or higher was led thereto.

Similar results as in Example were obtained.

(a) Chemical treating solution: 1.2 N hydrochloric acid
(b) Copper oxide electrode prepared by etching naked copper wire (purity 99.99%) with a diameter of 1 mm in a 0.5 N HCl solution at a liquid temperature of 30° C. for 5 seconds and then oxidizing the etched copper wire in 0.5 N KOH at liquid temperature of 30° C. for 15 minutes.
(c) Titrating solution:

| | |
|---|---|
| NaOH | 52 g |
| Water to make total volume 1 l | |

(d) Makeup solution for adjusting pH of the treating solution: 12 N hydrochloric acid
(e) Standard solution for reference electrode: 0.1 N hydrochloric acid

EXAMPLE 3

A chemical treating solution as given below under (a) was used in alkali washing of metal. The pH of the chemical treating solution was kept continuously at 13.7 with a copper oxide electrode, a titrating solution, a makeup solution for adjusting pH of treating solution, and a standard solution for reference electrode as given below under (b)-(e) in the same manner as in Example 1 in the same system as shown in FIG. 1. The similar results as in Example 1 were obtained.

(a) Chemical treating solution

| | |
|---|---|
| NaOH | 20 g |
| Water to make total volume 1 l | |

(b) Copper oxide electrode prepared by etching naked copper wire (purity 99.9%) with a diameter of 1 mm in a 0.5 N $H_2SO_4$ solution at a liquid temperature of 30° for 5 seconds and then oxidizing the etched copper wire in 0.5 N NaOH at a liquid temperature of 30° C. for 15 minutes.
(c) Titrating solution

| | |
|---|---|
| 12 N hydrochloric acid | 37.5 ml |
| $KH_2PO_4$ | 6.8 g |
| Water to make total volume 1 l | |

(d) Makeup solution for adjusting pH of the treating solution

| | |
|---|---|
| NaOH | 400 g |
| Water to make total volume 1 l | |

(e) Standard solution for reference electrode
0.1 N hydrochloric acid

EXAMPLE 4

In chemical copper plating with the same chemical copper plating solution as in Example 1 in the same manner as in Example 1, the pH and the concentration of formaldehyde were controlled. The pH control was carried out in the same manner as in Example 1, and control of formaldehyde was carried out with an automatic analyzing solution, a copper oxide electrode, a washing solution for the copper oxide electrode, and a makeup solution for adjusting the concentration of formaldehyde as given below under (a)–(e).

(a) Automatic analyzing solution for formaldehyde

| | |
|---|---|
| $Na_2SO_3$ | 100 g |
| Water to make total volume 1 l | |

(b) Copper oxide electrode prepared by etching naked copper wire (purity: 99.99%) with a diameter of 1 mm in 14 N nitric acid at a liquid temperature of 18° C. for one second, and then oxidizing the etched copper wire in 1 N caustic soda at 18° C. for 5 minutes.

(c) Electrode (the same as used in the pH measurement) Copper oxide-electrode-calomel electrode (using an aqueous saturated KCl solution)

(d) Washing solution for the copper oxide electrode 7 N nitric acid (e) Makeup solution for adjusting the concentration of formaldehyde

| | |
|---|---|
| 37% formalin | 200 ml |
| Water to make total volume 1 l | |

Figure 2:
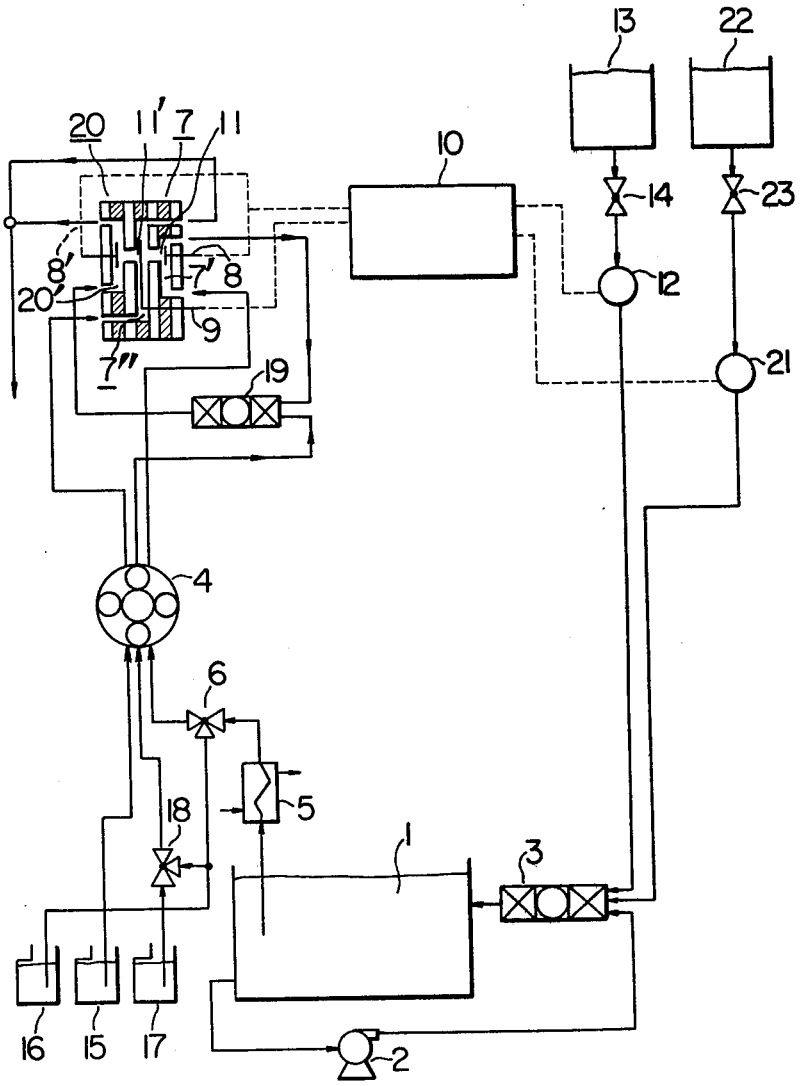

The control system is given in FIG. 2. At first, the pH control of the chemical copper plating solution was carried out by means of members 1–18 in FIG. 2 in the same manner as in Example 1, and the similar results as in Example 1 were obtained.

The sample solution leaving the pH detection cell 7 of FIG. 2 was led to a mixter 19 together with an automatic analyzing solution for formaldehyde as given above under (a), sampled from a titrating solution tank 17 through a three-way electromagnetic valve 18 by the sampling pump 4, and thoroughly mixed together, and then led to a main electrode chamber 20' of a formaldehyde concentration detection cell 20, where a difference in potential was detected between an copper oxide electrode 8' and a silver-silver chloride electrode 8 by means of the controller 10. Numeral 11' is a membrane. When the detected potential was smaller than the preset potential in the controller, a signal was transmitted to a makeup pump 21 to supply a makeup solution as given above under (e) from a makeup solution tank 22 for adjusting the concentration of formaldehyde to the plating tank 1 through a valve 23 and the mixer 3 until the detected potential exceeded the preset potential. On the other hand, an aqueous saturated KCl solution was continuously supplied to the reference electrode chamber 7'' from the standard solution tank 15 by the sampling pump 4 as the standard solution for the reference electrode to obtain a stable potential from the silver-silver chloride electrode 9 in the reference electrode chamber 7''. The sampled solution of the plating solution leaving the formaldehyde concentration detection cell 20 and the aqueous saturated KCl solution leaving the reference electrode chamber 7'' were thrown away. Furthermore, an aqueous 7 N nitric acid solution was supplied to the detection cells 7 and 20 from the washing solution tank 16 as a washing solution for the copper oxide electrode as given above under (d) through the sampling pump 4 for about 10 seconds before conducting the automatic control of the plating solution by switching the three-way valves 6 and 18.

According to the aforementioned automatic control system for the pH and the formaldehyde concentration of the plating solution, the plating solution could be automatically controlled for a continuation of 168 hours, where the sampling rate of the sampling pump 4 was 50 ml/l, the temperature of detected plating solution was about 25° C. owing to the cooler 5, the preset potential for the pH of the plating solution was −0.260 V, and the preset potential for the formalin concentration was −0.300 V.

Under these conditions, the pH of the plating solution could be automatically controlled to 12.3±0.07 and the formalin concentration to 3±1 ml/l.

EXAMPLE 5

In chemical copper plating with the same chemical copper plating solution as used in Example 1, in the same manner as in Example 1, the pH, the concentration of cupric ions, and the concentration of the complexing agent were controlled. The pH control was carried out in the same manner as in Example 1, and control of the concentration of cupric ions and the concentration of the complexing agent was carried out with automatic analyzing solutions, an electrode, a makeup solution for adjusting the copper concentration and a makeup solution for adjusting the complexing agent concentration as given below under (a)–(e).

(a) Automatic analyzing solution for cupric ions

| | |
|---|---|
| $CuSO_4 \cdot 5H_2O$ | 14.107 g |
| HCOONa | 64 g |
| 12 N hydrochloric acid | 30 ml |
| Water to make total volume 1 l | |

(b) Automatic analyzing solution for complexing agent (b-1) Triethylenetetramine solution

| | |
|---|---|
| Triethylenetetramine | 100 ml |
| 12 N hydrochloric acid | 164 ml |
| Water to make total volume 1 l | |

(b-2) Iron ion-containing solution

| | |
|---|---|
| $Fe_2(SO_4)_3(NH_4)_2SO_4 \cdot 24H_2O$ | 50.260 g |
| Water to make total volume 1 l | |

(c) Electrode (for measuring the concentrations of cupric ions and complexing agent)

| | |
|---|---|
| Main electrode | Platinum |
| Auxiliary electrode | Silver-silver chloride electrode |

(d) Makeup solution for adjusting the copper concentration

| | |
|---|---|
| $CuSO_4 \cdot 5H_2O$ | 250 g |
| Water to make total volume 1 l | |

(e) Makeup solution for adjusting the complexing agent concentration

| | |
|---|---|
| EDTA . 2Na | 100 g |
| Water to make total volume 1 l | |

Figure 3:
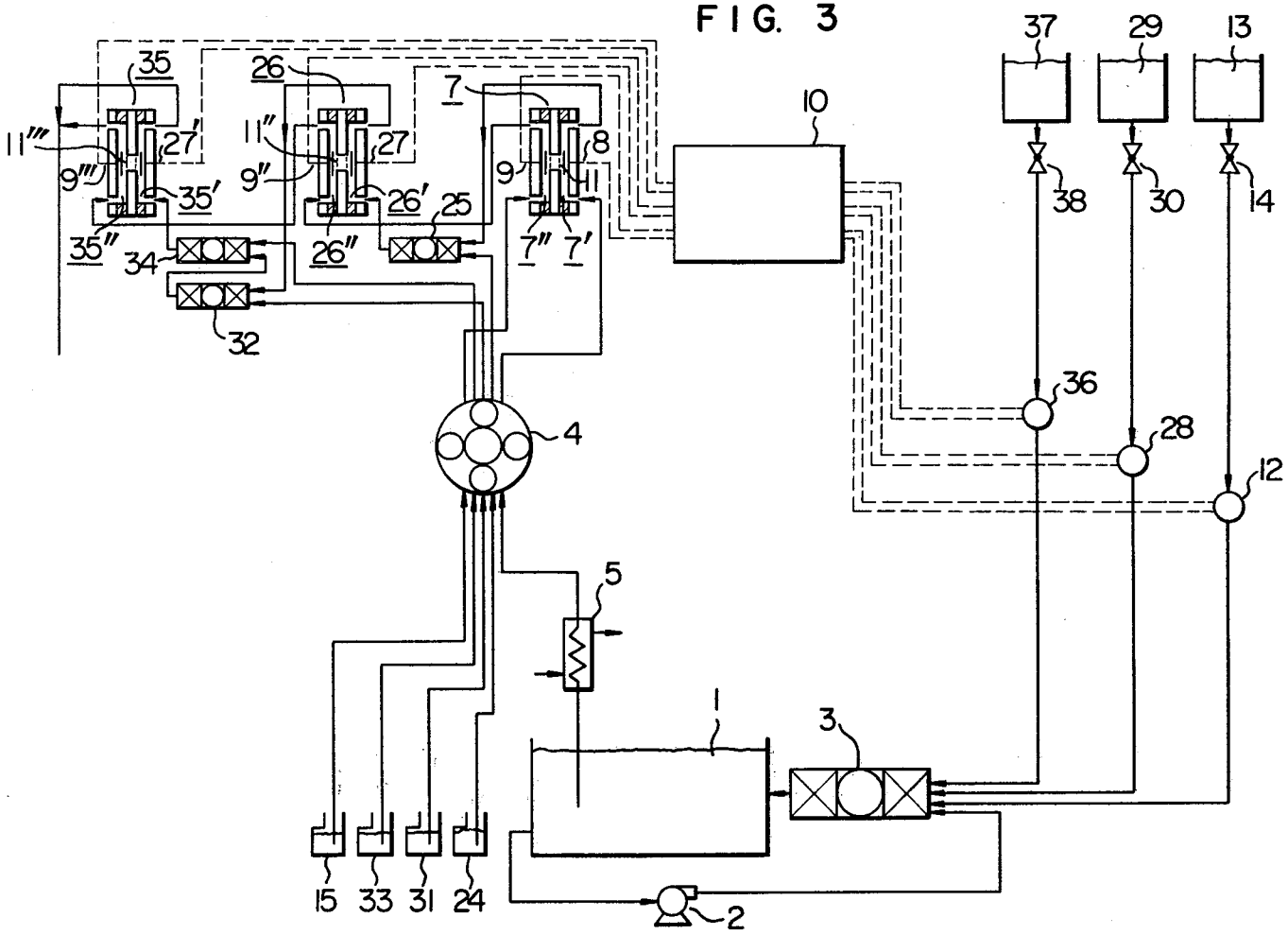

Control system is shown in FIG. 3. At first, the pH control was carried out by members 1 to 14 in FIG. 3, and the similar results as in Example 1 were obtained.

The sampling solution leaving the pH detection cell 7 of FIG. 3 was led to a mixer 25 together with an automatic analyzing solution for cupric ions as given above under (a), sampled from a titrating solution tank 24 by the sampling pump 4, thoroughly mixed, and led to a main electrode chamber 26' of a cupric ion concentration detection cell 26, where a difference in potential was measured between a platinum electrode 27 and a silver-silver chloride electrode 9'' by means of the controller 10. Numeral 11' is a membrane. When the detected potential was smaller than the preset potential in the controller, a signal was transmitted to a makeup pump 28 from the controller 10 to supply a makeup solution as given above under (d) to the plating tank 1 from a makeup solution tank 29 for adjusting the cupric ion concentration through a valve 30 and the mixer 3 until the detected potential exceeded the preset potential.

On the other hand, an aqueous saturated KCl solution was continuously supplied to a reference electrode chamber 26'' from the reference electrode chamber 7'' of the pH detection cell 7 to obtain a stable potential from the silver-silver chloride electrode 9'' in the reference electrode chamber 26''. The aqueous saturated KCl solution leaving the reference electrode chamber 26'' of the cupric ion concentration detection cell 26 was led to a reference electrode chamber 9''' of a complexing agent concentration detection cell 35, and then thrown away.

The sampled solution leaving the cupric ion concentration detection cell 26 was led to a mixer 32 together with a triethylenetetramine solution as given above under (b-1), sampled from a titrating solution tank 31 by the sampling pump 4, thoroughly mixed, then led to a mixer 34 together with an iron ion-containing solution as given above under (b-2), sampled from a titrating solution tank 33 by the sampling pump 4, thoroughly mixed, and subjected to reaction. Then, the resulting solution was led to the main electrode chamber 35' of a complexing agent concentration detection cell 35, where a difference in potential was detected between a platinum electrode 27' and a silver-silver chloride electrode 9'' by means of the controller 10. Numeral 11''' is a membrane. When the detected potential was larger than the preset potential in the controller, a signal was transmitted to a makeup pump 36 to supply a makeup solution as given above under (e) to the plating tank 1 from a makeup tank 37 for adjusting the concentration of complexing agent through a valve 38 and the mixer 3 until the measured potential became smaller than the preset potential. The sampled solution leaving the main electrode chamber 27' was thrown away.

The concentration of cupric ions and the concentration of complexing agent could be thus automatically controlled for a continuation of 116 hours, where the sampling rate of the sampling pump 4 was 50 ml/l, the temperature of detected plating solution was about 25° C. owing to the cooler 5, the preset potential for the pH of the plating solution was −0.260 V, the preset potential for the concentration of cupric ions was 0.100 V, and the preset potential for the concentration of complexing agent was 0.150 V.

Under these conditions, the pH could be automatically controlled to 12.3±0.04, the concentration of cupric ions to 13.1±0.53 g/l, and the concentration of complexing agent to 40±0.7 g/l.

EXAMPLE 6

Figure 4:
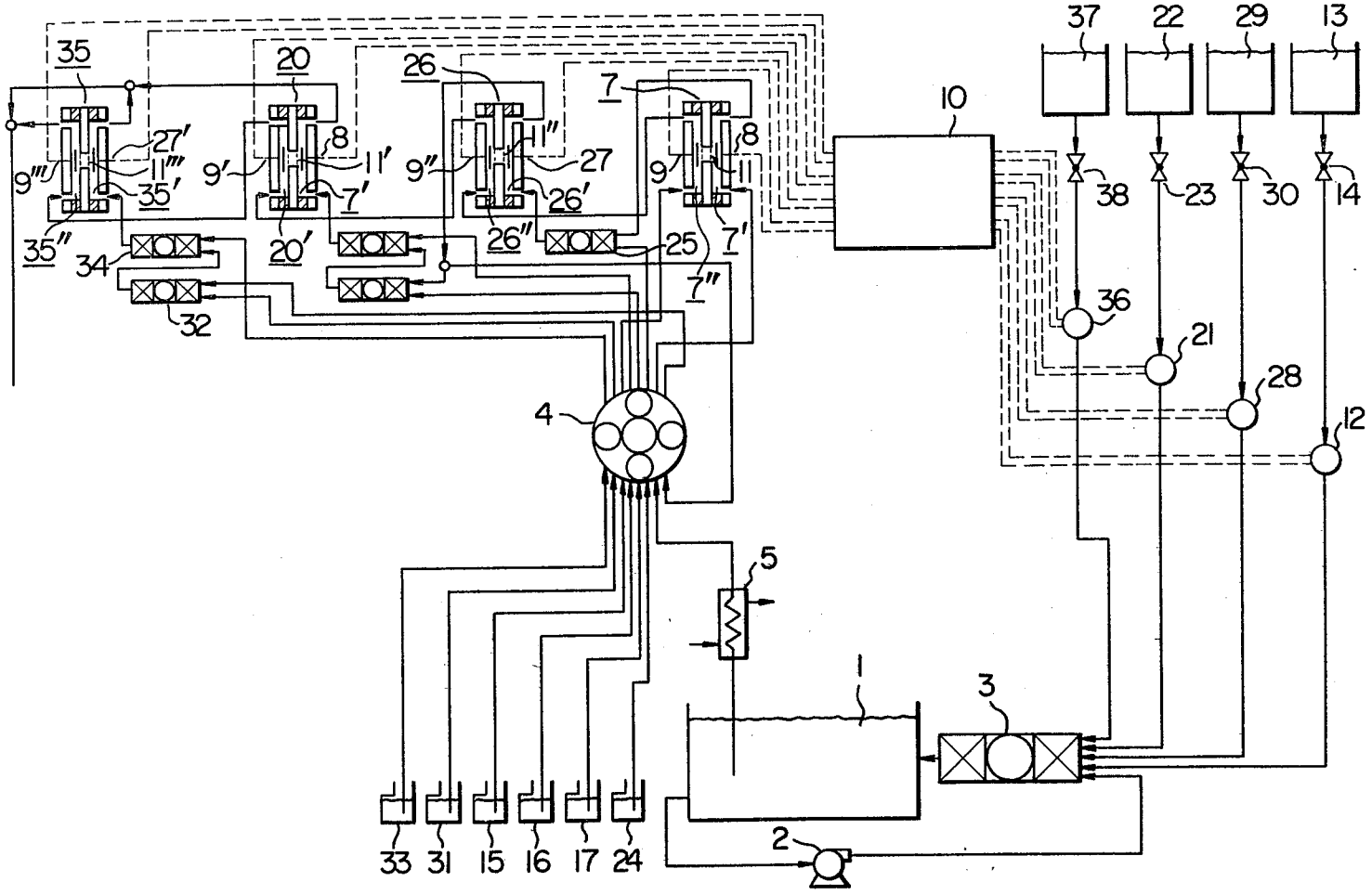

Automatic control of the same chemical plating solution as in Example 1 was carried out in a system as shown in FIG. 4 by measuring pH and the concentration of cupric ions in the same manner as in Examples 1 and 5, then by measuring the concentration of the reducing agent, and then by measuring the concentration of the complexing agent in the same manner as in Example 5. The pH control was carried out in the same manner as in Example 1, and control of the concentrations of cupric ions, the reducing agent and the complexing agent was carried out with automatic analyzing solutions, electrodes, and makeup solutions for adjusting the concentrations as given below under (a) to (h).

(a) Automatic analyzing solution for cupric ions

| | |
|---|---|
| $CuSO_4 . 5H_2O$ | 14.107 g |
| HCOONa | 64 g |
| 12 N hydrochloric acid | 30 ml |
| Water to make total volume 1 l | |

(b) Automatic analyzing solution for the reducing agent (b-1) Sulfite ion-containing solution

| | |
|---|---|
| $Na_2SO_4$ | 50 g |
| EDTA-2Na | 15 g |
| NaOH | 4 g |
| $Na_2SO_3$ | 4.593 g |
| Water to make total volume 1 l | |

(b-2) Iodine-containing solution

| | |
|---|---|
| KI | 40 g |
| $I_2$ | 5.076 g |
| Water to make total volume 1 l | |

(c) Automatic analyzing solution for the complexing agent (c-1) Triethylenetetramine solution

| | |
|---|---|
| Triethylenetetramine | 100 ml |
| 12 N hydrochloric acid | 164 ml |
| Water to make total volume 1 l | |

(c-2) Iron ion-containing solution

| | |
|---|---|
| $Fe_2(SO_4)_3(NH_4)_2SO_4 . 24H_2O$ | 25.130 g |
| Water to make total volume 1 l | |

(d) Electrodes for measuring the concentrations of cubric ions, reducing agent and complexing agent

| | |
|---|---|
| Main electrode | Platinum |
| Auxiliary electrode | Silver-silver chloride electrode |

(e) Makeup solution for adjusting the copper concentration

| | |
|---|---|
| $CuSO_4 . 5H_2O$ | 250 g |
| Water to make total volume 1 l | |

(f) Makeup solution for adjusting the reducing agent concentration

| | |
|---|---|
| 37% formalin | 200 ml |
| Water to make total volume 1 l | |

(g) Makeup solution for adjusting the complexing agent concentration

| | |
|---|---|
| EDTA-2Na | 100 g |
| Water to make total volume 1 l | |

(h) Standard solution: 0.1 N hydrochloric acid

The control system is shown in FIG. 4. At first, the pH control and the control of the cupric ion concentration and the complexing agent were carried out by members 1 to 30 in FIG. 4 in the same manner as in Examples 1 and 5. In the present embodiment, the sampled solution leaving the cupric ion concentration detection cell 26 was devided into two streams, and one stream was led to the main electrode chamber 7' of the complexing agent detection cell 20, whereas the other stream was led to a mixer 32, after the flow rate was adjusted by the sampling pump 4, together with a sulfite ion-containing solution as given above under (b-1), sampled from a titrating solution tank 31 by the sampling pump 4, thoroughly mixed, then led to a mixer 34 together with an iodine-containing solution, as given above under (b-2), sampled from a titrating solution tank 33 by the sampling pump 4, thoroughly mixed, and subjected to reaction. Then, the stream was led to a main electrode chamber 35' of a reducing agent detection cell 35, where a difference in potential was detected between a platinum electrode 27' and a silver-silver chloride electrode 9''' by means of the controller 10. Numeral 11''' is a membrane. When the detected potential was smaller than the present potential in the controller, a signal was transmitted from the controller to a makeup pump 36 to supply a makeup solution, as given above under (f), to the plating tank 1 from a makeup tank 37 for adjusting the reducing agent through a valve 38 and the mixer 3 until the detected potential exceeded the present potential. The sampled solution leaving the main electrode chamber 35' was thrown away.

On the other hand, a standard solution, as given above under (h), leaving the reference electrode chamber 20' of the complexing agent concentration detection cell 20 was led to a reference electrode chamber 9''' of the reducing agent concentration detection cell 35 to obtain a stable potential from the silver-silver chloride electrode 9''' in the reference electrode chamber 35'', and then thrown away. The pH, the cupric ion concentration, the reducing agent concentration and the complexing agent concentration of the chemical copper plating solution could be thus automatically controlled for a continuation of 100 hours, where the sampling rate of the sampling pump was 50 ml/l, the detection temperature of sampling plating solution was about 25° C. owing to the cooler 5, the present potential for the pH of the plating solution was −0.260 V, the present potential for the cupric ion concentration was 0.100 V, the present potential for the reducing agent concentration was 0.050 V, and the present potential for the complexing agent concentration was 0.150 V. Under these conditions, the pH could be automatically controlled to 12.3±0.04, the cupric ion concentration to 13±0.52 g/l, the reducing agent concentration to 3±0.15 ml/l, and the complexing agent concentration to 40±0.8 g/l with high controlling exactness.

Since the pH of the plating solution could be measured stably with good exactness for a prolonged time by means of a copper oxide electrode, the pH of the plating solution could be adjusted with good exactness in the present embodiment. As a result, a titration error due to a pH change was small in the titration for measuring the concentration of cupric ions, reducing agent and complexing agent, and these concentrations could be adjusted with improved exactness. Furthermore, since a change in the pH of the plating solution was small, no precipitation of the titrating solutions took place in conduits, and thus the control system had an improved reliability.

In the present example, a non-soluble electrode such as electrodes of gold, tungsten, carbon, palladium, etc. can be used in place of platinum as the main electrode for measuring the concentration of the reducing agent with similar results.

What is claimed is:

1. A method for controlling a composition of a chemical copper plating solution, which comprise leading a predetermined amount of a chemical copper plating solution sampled from a plating tank to a main electrode chamber of a pH detection cell comprising a main electrode chamber with a copper oxide electrode, a reference electrode chamber with a reference electrode and a membrane provided between both chambers, while leading a reference electrode solution to the reference electrode chamber, detecting a difference in potential between the copper oxide electrode and the reference electrode, and transmitting the difference as a signal from a pH controller when the detected potential is smaller than a present potential in the pH controller as an absolute value, thereby supplementing the chemical copper plating solution with a pH makeup solution until the detected potential exceeds the preset potential, and thereby keeping the pH of the chemical copper plating solution continuously constant.

2. A method according to claim 1, wherein the copper oxide electrode is an electrode prepared by etching metallic copper in 0.1–1 N hydrochloric acid, sulfuric acid or nitric acid and then oxidizing the etched metallic copper in an aqueous 0.1–1 N caustic soda or caustic potash solution, the reference electrode is a silver-silver chloride electrode, and the reference electrode solution is an chlorine ion-containing solution.

3. A method for controlling a composition of a chemical copper plating solution, which comprises leading a predetermined amount of a chemical copper plating solution sampled from a plating tank to a main electrode chamber of a pH detection cell comprising a main electrode chamber with a copper oxide electrode, a reference electrode chamber with a reference electrode, and a membrane provided between both chambers, whereas leading a reference electrode solution to the reference electrode chamber, detecting a difference in potential between the copper oxide electrode and the reference electrode by a pH controller, transmitting the difference as a signal from the pH controller when the detected potential is smaller than a preset potential in the pH controller as an absolute value, thereby supplementing the chemical copper plating solution with a pH-adjusting solution until the detected potential exceeds the preset potential, and thereby keeping the pH of the chemical copper plating solution continuously constant, adding a sulfite ion containing solution to the sampled solution leaving the main electrode chamber of the pH detection cell, then leading said solution to a main electrode chamber of a reducing agent concentration detecting cell comprising a main electrode chamber with a copper oxide electrode, a reference electrode chamber with a reference electrode and a membrane provided between both chambers, whereas leading a reference electrode solution to the reference electrode chamber of the reducing agent concentration detection cell, detecting a difference in potential between the copper oxide electrode and the reference electrode, transmitting the difference as a signal from a reducing agent concentration controller when the detected potential is smaller than a preset potential in the reducing agent concentration controller as an absolute value, thereby supplementing the chemical copper plating solution with a reducing agent makeup solution until the detected potential exceeds the preset potential, and thereby keeping the reducing agent concentration of the chemical copper plating solution continuously constant.

4. A method according to claim 3, wherein the copper oxide electrodes for the pH detection cell and the reducing agent concentration detection cell are electrodes prepared by etching metallic copper in 0.1–1 N hydrochloric acid, sulfuric acid or nitric acid and then oxidizing the etched metallic copper in an aqueous 0.1–1 N caustic soda or caustic potash solutin, the reference electrodes for the pH detection cell and the reducing agent detection cell are silver-silver chloride electrodes, and the reference electrode solutions are an chlorine ion-containing solution.

5. A method for controlling a composition of a chemical copper plating solution, which comprises leading a predetermined amount of a chemical copper solution sampled from a plating tank to a main electrode chamber of a pH detection cell comprising a main electrode chamber with a copper oxide electrode, a reference electrode chamber with a reference electrode and a membrane provided between both chambers, while leading a reference electrode solution to the reference electrode chamber, detecting a difference in potential between the copper oxide electrode and the reference electrode, transmitting the difference as a signal from a pH controller when the detected potential is smaller than a preset potential in the pH controller as an absolute value, thereby supplementing the chemical copper plating solution with a pH-adjusting solution until the detected potential exceeds the preset potential, and thereby keeping the pH of the chemical copper plating solution continuously constant, adding a $Cu^{+2}$ ion containing solution to the sampled solution leaving the main electrode chamber of the pH detection cell, then leading said solution to a main electrode chamber of a cupric ion concentration detection cell comprising a main electrode chamber with a non-soluble electrode, a reference electrode chamber with a reference electrode and a membrane provided between both chambers, while leading a reference electrode solution to the reference chamber of the cupric ion concentration detection cell, detecting a difference in potential between the non-soluble electrode and the reference electrode, transmitting the difference as a signal from a cupric ion concentration controller when the detected potential is smaller than a preset potential in the cupric ion concentration detector, thereby supplementing the chemical copper plating solution with a cupric ion-adjusting solution until the detected potential exceeds the preset potential and thereby keeping the cupric ion concentration of the chemical copper plating solution cintinuously constant, adding a triethylenetetramine containing solution and a $Fe^{+3}$ ion containing solution to the sampled solution leaving the main electrode chamber of the cupric ion detection cell, then leading said solution to a main electrode chamber of a complexing agent concentration detection cell comprising a main electrode chamber with a non-soluble electrode, a reference electrode chamber with a reference electrode, and a membrane provided between both chambers, while leading a reference electrode solution to the reference electrode chamber of the complexing agent concentration detection cell, detecting a difference in potential between the non-soluble electrode and the reference electrode, and transmitting the difference as a signal from a complexing agent concentration controller when the detected potential is higher than a preset potential in the complexing agent concentration controller, thereby supplementing the chemical copper plating solution with a complexing agent-adjusting solution until the detected potential becomes lower than the preset potential, and thereby keeping the complexing agent concentration of the chemical copper plating solution continuously constant.

6. A method according to claim 5, wherein the copper oxide electrode for the pH detection cell is an electrode prepared by etching metallic copper in 0.1–1 N hydrochloric acid, sulfuric acid or nitric acid and then oxidizing the etched metallic copper in an aqueous 0.1–1 N caustic soda or caustic potash solution, the reference electrodes for the pH detection cell, the cupric ion concentration cell and the complexing agent concentration cell are silver-silver chloride electrodes, and the references electrode solutions are a chlorine ion-containing solution.

7. A method for controlling a composition of a chemical copper plating solution, which comprises leading a predetermined amount of a chemical copper plating solution sampled from a plating tank to a main electrode chamber of a pH detection cell comprising a main electrode chamber with a copper oxide electrode, a reference electrode chamber with a reference electrode and a membrane provided between both chambers, while leading a reference electrode solution to the reference electrode chamber, detecting a difference in potential between the copper oxide electrode and the reference electrode, transmitting the difference as a signal from a controller when the detected potential is smaller than a preset potential in the pH controller as an absolute value, thereby supplementing the chemical copper plating solution with a pH-adjusting solution until the detected potential exceeds the preset potential and thereby keeping the pH of the chemical copper plating solution continuously constant, adding a $Cu^{+2}$ ion containing solution to the sampled solution leaving the main electrode chamber of the pH detection cell, then leading said solution to a main electrode chamber of a cupric ion concentration detection cell comprising a main electrode chamber with a non-soluble electrode, a reference electrode chamber with a reference electrode, and a membrane provided between both chambers, while leading a reference electrode solution to the reference electrode chamber of the cupric ion concentration cell, detecting a difference in potential between the non-soluble electrode and the reference electrode, transmitting the difference as a signal from a cupric ion concentration controller when the detected potential is smaller than a preset potential in the cupric ion concentration controller, thereby supplementing the chemical copper plating solution with a cupric ion-adjusting solution until the detected potential exceeds the preset potential and thereby keeping the cupric ion concentration of the chemical copper plating solution continuously constant, adding a sulfite containing solution and an iodine ion containing solution to the sampled solution leaving the main electrode chamber of the cupric ion detection cell, then leading said solution to a main electrode chamber of a reducing agent concentration detection cell comprising a main electrode chamber with a copper oxide electrode or non-soluble electrode, a reference electrode chamber with a reference electrode, and a membrane provided between both chambers, while leading a reference electrode solution to the reference electrode chamber of the reducing agent concentration detection cell, detecting a difference in potential between the copper oxide electrode or non-soluble electrode and the reference electrode, transmitting the difference as a signal from a reducing agent concentration controller when the detected potential is smaller than a preset potential in the reducing agent concentration controller as an absolute value, thereby supplementing the chemical copper plating solution with a reducing agent-adjusting solution until the detected potential exceeds the preset potential and thereby keeping the reducing agent concentration of the chemical copper plating solution continuously constant, adding a triethylenetetramine containing solution and a $Fe^{+3}$ containing solution to the sampled solution leaving the main electrode chamber of the cupric ion detection cell, then leading said solution to a main electrode chamber of a complexing agent concentration detection cell comprising a main electrode chamber with a non-soluble electrode, a reference electrode chamber with a reference electrode and a membrane provided between both chambers, while leading a reference electrode solution to the reference electrode chamber of the complexing agent concentration detection cell, detecting a potential between the non-soluble electrode and the reference electrode, transmitting the difference as a signal from a complexing agent concentration controller when the detected potential is larger than a preset potential in the complexing agent concentration controller, thereby supplementing the chemical copper plating solution with a complexing agent-adjusting solution until the detected potential becomes lower than the preset potential, and thereby keeping the complexing agent concentration of the chemical copper plating solution continuously constant.

8. A method according to claim 7, wherein the copper oxide electrode for the pH detection cell and the reducing agent detection cell are electrodes prepared by etching metallic copper in 0.1–1 N hydrochloric acid, sulfuric acid or nitric acid and then oxidizing the etched metallic copper in an aqueous 0.1–1 N caustic soda or caustic potash solution, the reference electrodes for the pH detection cell, the reducing agent concentration detection cell, the cupric ion concentration detection cell and the complexing agent concentration detection cell are silver-silver chloride electrodes, and the reference electrode solutions are a chlorine ion-containing solution.

* * * * *